US008858401B2

(12) United States Patent
Kaupe

(10) Patent No.: US 8,858,401 B2
(45) Date of Patent: Oct. 14, 2014

(54) TRAINING POLE FOR ATHLETES

(76) Inventor: Georg H. Kaupe, Bonn (DE)

( * ) Notice: Subject to any disclaimer, the term of this patent is extended or adjusted under 35 U.S.C. 154(b) by 272 days.

(21) Appl. No.: 13/147,816

(22) PCT Filed: Mar. 13, 2010

(86) PCT No.: PCT/DE2010/000275

§ 371 (c)(1),
(2), (4) Date: Oct. 20, 2011

(87) PCT Pub. No.: WO2010/111991

PCT Pub. Date: Oct. 7, 2010

(65) Prior Publication Data

US 2012/0053018 A1 Mar. 1, 2012

(30) Foreign Application Priority Data

Apr. 1, 2009 (DE) ..... 10 2009 015 817
Aug. 18, 2009 (DE) ..... 10 2009 037 960

(51) Int. Cl.

| | |
|---|---|
| ***A63B 22/00*** | (2006.01) |
| ***A63B 22/20*** | (2006.01) |
| ***A45B 1/00*** | (2006.01) |
| ***A61H 3/04*** | (2006.01) |
| ***A63C 11/22*** | (2006.01) |
| ***A63C 17/00*** | (2006.01) |
| ***A45B 1/02*** | (2006.01) |
| *A45B 9/02* | (2006.01) |
| *A63B 69/00* | (2006.01) |
| *A45B 7/00* | (2006.01) |
| *A45B 9/00* | (2006.01) |

(52) U.S. Cl.

CPC ..... *A45B 1/02* (2013.01); *A63C 11/228* (2013.01); *A45B 9/02* (2013.01); *A45B 2200/055* (2013.01); *A63B 2069/0033* (2013.01); *A63B 2220/00* (2013.01); *A63C 17/0013* (2013.01); *A45B 7/00* (2013.01); *A45B 2009/007* (2013.01)

USPC ..... 482/51; 482/66; 482/148; 482/68; 135/65; 135/77; 135/85; D3/7

(58) Field of Classification Search

USPC ..... 135/15.1, 65, 66, 67, 68, 69, 71, 72, 73, 135/74, 75, 76, 82, 85, 86; 280/47.3; 482/3, 482/66, 67; D3/7; 248/688; 701/1

See application file for complete search history.

(56) References Cited

U.S. PATENT DOCUMENTS 1,244,249 A * 10/1917 Schlick ..... 135/71
1,334,208 A * 3/1920 Ames Byron F ..... 135/68
1,542,894 A * 6/1925 Langner ..... 40/317

(Continued)

*Primary Examiner* — Loan H Thanh
*Assistant Examiner* — Rae Fischer
(74) *Attorney, Agent, or Firm* — Andrew Wilford

(57) ABSTRACT

A training apparatus for a Nordic walker has an elongated pole whose lower end carries at least one wheel having a freewheel permitting rolling of the wheel on the surface only in a forward travel direction. A forearm rest is freely pivotal on an upper end of the pole and defines with the pole an angle increasing on forward rolling of the wheel from a position behind the athlete to a position in front of the athlete as the arm in the rest swings forward in the travel direction. A handgrip fixed on a front end of the forearm rest is gripped by a hand of the forearm in the rest and pivots with the forearm rest. A spring braced between the rest and the pole and pivotally biases the rest so as to increase the inclination angle.

12 Claims, 2 Drawing Sheets

(56) References Cited

U.S. PATENT DOCUMENTS

| | | | | | |
|---|---|---|---|---|---|
| 3,635,233 | A | * | 1/1972 | Robertson | 135/71 |
| 3,792,307 | A | * | 2/1974 | Baker | 315/77 |
| 3,879,048 | A | | 4/1975 | Penney | |
| 4,099,535 | A | * | 7/1978 | Hubachek | 135/66 |
| 4,456,284 | A | | 6/1984 | Saka | |
| 4,817,939 | A | * | 4/1989 | Augspurger et al. | 482/61 |
| 5,063,762 | A | * | 11/1991 | Vandeweghe | 70/30 |
| 5,564,451 | A | * | 10/1996 | Hagberg | 135/68 |
| 5,938,240 | A | | 8/1999 | Gairdner | |
| 6,342,032 | B1 | | 1/2002 | Affield | |
| 6,733,042 | B1 | | 5/2004 | Klemetti | |
| 2007/0249472 | A1 | * | 10/2007 | Frei | 482/66 |
| 2009/0312155 | A1 | * | 12/2009 | Ikeuchi et al. | 482/51 |
| 2011/0126872 | A1 | * | 6/2011 | Albertyn | 135/69 |

* cited by examiner

TRAINING POLE FOR ATHLETES

CROSS REFERENCE TO RELATED APPLICATIONS

This application is the US-national stage of PCT application PCT/DE2010/000275 filed 13 Mar. 2010, published 7 Oct. 2010 as WO2010/111991, and claiming the priority of German patent application 102009015817.0 itself filed 1 Apr. 2009 and German patent application 102009037960.6 itself filed 18 Aug. 2009.

FIELD OF THE INVENTION

The invention relates to a training pole for athletes, such as, for example, Nordic walkers, joggers, walkers, roller skaters or summer cross-country skiers, who move on a surface in a travel direction using an elongated pole whose lower end is provided with at least one wheel.

BACKGROUND OF THE INVENTION

In recent years, exercise sports such as, for example, Nordic Walking, running, jogging, skating, or cross-country skiing have become increasingly popular among the general public since these sports are healthy and, in particular, promote the physical well-being of the athletes. However, these sports produce concentrated load spectra in individual muscle and joint groups that may at times result in physical injuries. On the other hand, such overstressing is reduced by targeted exercise training and by the use of auxiliary aids. The known auxiliary aids are being continuously improved so as to even further reduce stress on the relevant muscle and joint groups. For example, the above-referenced training poles are well-known for Nordic walking.

DE 20 2005 014 822 discloses a hiking pole comprising a handgrip, a preferably telescoping pole shaft, and a ground-end foot. On its foot, the hiking pole has at least one unidirectionally rotatable roller to contact the ground, while the handgrip has a grip piece that is preferably oriented perpendicular to the longitudinal extension of the pole shaft.

Another training pole for athletes is described in EP 01744817 [US 2007/0249472], this pole also having an elongated body at whose bottom end at least one wheel is mounted that enables a directed forward rolling motion of the training pole along the ground. The wheel is equipped with a return-motion lock that allows the wheel to rotate in the travel direction but prevents it from rotating opposite the travel direction.

The disadvantage of the known training poles is that using them often does not yield the desired effect since the athletes have the feeling of having to perform an artificial and unnatural movement that they then do not practice consistently enough. For example, after a certain period of time—specifically, as a rule after completing the instruction phase—Nordic walkers often only drag the poles behind themselves half-heartedly without thereby exerting a real supporting force, and this has disadvantageous consequences for the desired training success.

OBJECT OF THE INVENTION

The object of this invention is therefore to propose a training pole by which the disadvantages of the training poles known from the art are eliminated.

SUMMARY OF THE INVENTION

This object is achieved by the training pole according to the invention in that a forearm rest is attached to the upper end of the pole, the inclination angle $\alpha$ of the rest being variable relative to the longitudinal axis of the pole and the rest being pivotable against the force of a spring or of an elastic restoring element to create greater inclination angles. The pivotal attachment of the forearm rest can preferably be implemented by a hinged attachment of the forearm rest. Alternatively, an embodiment can be considered in which the forearm rest is attached to the upper end of the pole either rigidly or in a slightly restricted pivoting, and the elastic pivotability, which is required according to the invention, of the forearm rest is implemented by one end of the pole that is elastically deformable by bending. In this case, the pivotability of the forearm rest is produced not by a pivot but by appropriate bending deformation.

The training pole according to the invention is a device that allows for the perception of a rolling motion where the center point of the rolling motion is located in or near the shoulder joint and the rolling contact path is formed by the ground on which the running movement occurs. To this end, the athlete carries in each hand one training pole according to the invention. The athlete now moves his/her arms in a rhythm resembling Nordic Walking, where he/she can significantly increase the supporting forces on the poles since the forearm rests relieve the load on his/her wrists. During rearward motion of the arms, the freewheel, which is preferably provided at end of the pole, locks with the result that both an upward force (supporting force) and a forward force (thrust) releases or accelerates the travel. During the forward motion of the arms, the training pole rolls forward, optionally in load-free fashion and noiselessly due to the freewheel, and the athlete does not need to lift it.

When the training pole according to the invention is not being used, the forearm rest extends at an acute angle to the pole, which angle enlarges depending on its training use, i.e. in each case according to the degree of bend in the elbow joint, preferably up to 150°. The elastic restoring element, which can be composed of any elastic material, is preferably located below the forearm rest and is preferably attached underneath the pivot between the pole and the forearm rest. When the training pole according to the invention is used, the acute-angle arrangement always produces a basic tension in the elastic restoring element or the spring, which results in the wheel at the end of the pole being pressed against the ground in every moving position, which prevents the wheel from lifting off the ground when in use. The greater the angle between the pole and the forearm rest, the greater the contact pressure of the wheel against the ground.

The training pole according to the invention is a whole-body training device that is pulled by the pole behind the body, always maintains contact with the ground, and combines the aerobic training effect, that is, walking and jogging, with the anaerobic training component, and specifically static muscle training against a resistance. In addition, the entire back is stabilized by the parallel ground adherence of the rollers, while the muscles of the back are strengthened. The muscles of the shoulder-arm region and of the chest-waist are directly stimulated. In addition, consumption of calories is increased significantly as compared with conventional Nordic walking.

The training pole is thus an optimal whole-body training device for every person and every terrain, one that combines dynamic and static training modules. This form of training can be employed for walking, running, and at all age levels. Due to is supporting and stabilizing components, the training pole is also ideally suited for the field of medical rehabilitation since the major joints of the body are unstressed while the cardiovascular situation (cardiovascular system) is further strengthened.

The training pole can be very precisely matched to the kinematics of movement and thus to the body size of the athlete so that the pole reduces the stress on the athlete. To this end, provision is made in one particular embodiment for the pole to be designed to telescope which is achieved in that the pole is composed of multiple tubes that fit into each other, the elements being lockable by a clamping element and/or a detent element and/or a threaded adjustment. In addition, multiple pivots of the pole are provided on the forearm rest, the pole and the forearm rest being attached by a quick-release fastener. With these adjustment devices, the training pole can be optimally adapted both to body size and to the preferred body posture due to the length and position adjustments.

In a preferred embodiment, the pole is designed to be at least partly elastic, and/or the pole is formed in a bent configuration. The result is a continuously developed load rather than a jolting load that is generated when the support force is established, and this aspect is protective for the stressed muscle and joint groups. In addition, the pole is preferably formed in such a way that during the load cycle the forearm is automatically supported on a surface of the training pole that is straight in the longitudinal direction and trough-shaped in cross-section, with the result that the wrists rest in a neutral position on the wrist shell and are unstressed during the transmission of force.

The training pole preferably includes two stops that limit the inclination angle $\alpha$ formed between the forearm rest and the pole axis, the inclination angle $\alpha$ measuring 30° to 150°. This restricts motion in such a way that no exaggerated movements can be effected with the training pole. Movement can therefore not exceed naturally set limits.

In another preferred embodiment of the training pole, the forearm rest is formed like a shell and partially surrounds the forearm and the wrist, with the result that the forearm shell ergonomically adapts to the contour of the forearm. This prevents any pressure points during extended training sessions, and the forearm rests comfortably on the rest.

A handgrip is preferably disposed at the front end of the forearm rest, the upper end of this element being provided with a knob. The grip ensures that the training pole can be held tightly so that it does not slide back and forth during training. On the other hand, a clamp or coupling is advantageously disposed on the rear end of the forearm rest, with the result that the forearm is connected to the forearm rest in an elastically form-fitting manner, thereby enabling a pulling force also to be applied by the forearm when the training pole is swung forward. However, the clamp or coupling can transmit only limited forces so that the arms automatically release whenever these forces are exceeded so that no overstressing of the arms or the joints occurs in the event of a fall. For example, this clamp or coupling can be composed of two clamping jaws that grasp around the forearm by more than 180°. Alternatively, a hook and loop fastening strap can also be disposed that completely surrounds the forearm and thus secures it on the forearm rest.

The forearm rest is advantageously designed to be elastic both in the vertical and in the horizontal direction of force. First of all, the impact stress of placing the training pole down is thus cushioned, and, secondly, thrust is supported in the forward direction during walking/running.

In another embodiment of the invention, the cushioning of the forearm rest is implemented by a tension spring and/or elastic strap attached at one end to the forearm rest, preferably an arm shell, and at the other end to the pole. In order to allow individual adjustments to be made to the training pole, multiple attachment points for the elastic strap or the tension spring are provided on the forearm rest at various spacings from the pivot point, thereby enabling the increase in force to be variably adjusted during rotation of the forearm rest. Analogously, the attachments for the elastic strap or the tension spring can preferably be provided either in displaceable or equidistant fashion on the pole in the direction of the pole longitudinal axis.

In another embodiment of the invention, the retainer of the elastic strap under the tension spring on the pole is retracted into a clamp by the strap or spring tension, and self-locking displaceability and adjustability are thereby ensured.

Another embodiment of the invention provides an approach whereby the inclination angle of the forearm rest is detected by a sensor and recorded in a meter, with the result that the total mechanical work of a training session is measured. In addition, the pole incorporates an elastic element that is load-proportionally compressed when the supporting force is applied, and that provides for measurement of the total work of the supporting force for a training session. The above measures function to allow the forces exerted or work performed to be determined when the training pole is used, thus enabling the level of the training session to be appropriately set.

The wheel of the training pole is preferably designed to be replaced, and different wheels are provided for various ground surfaces and vary in terms of diameter, material hardness, and/or profile. This enables the training pole to be used on various terrains, thereby addressing the interests of different users. In one particular embodiment of the invention, the return-motion-locking effect does not act on the wheel axis but instead is generated by a contact wedge on the wheel surface.

Finally, the pole can be designed to telescope so that the training pole can be used by persons of different size or be individually adjusted.

In another embodiment, the training pole can have an out-of-round, preferably oval contour, thereby enabling any unwanted rotation or twisting to be prevented during telescoping of the telescoping section.

Finally, the training pole or pair of training poles has a strap whose opposite ends are attached to the respective forearm rests, preferably by a hook and loop fastener so that this strap can be passed from right to left behind the neck of the user when the training pole or pair of training poles are used, thereby preventing them from falling when the user lets go of the training poles.

According to one particular embodiment for use in inline skating or roller skiing one or more freewheels are disposed in each roller skate supplementally or alternatively to the freewheels in the wheel. As a result, the athlete can now execute a form of motion in which he/she no longer has to brace himself/herself laterally in order to prevent the roller skates during forward motion from rolling rearward; instead, he/she can roll along in directly forward-guided fashion since the freewheels function similarly to skins on skis. As a result, movement sequences become less injurious for the hip joints and produce an improved effect in building muscle. Roller skis can be analogously equipped.

In overall terms, the training pole is an athletic, training, and exercise device that can be used for jogging, running, on Rollerblades, on cross-country skis, and other equipment to support forward motion. By using the training pole, a supporting force is applied relative to the ground through the arms and the shoulders of the training person, with the result that, first of all, part of the weight is supported directly while avoiding stressing the legs and the lumbar spine, and, secondly, a forward-directed force is transmitted to support forward motion.

BRIEF DESCRIPTION OF THE DRAWING

The following discussion describes a specific embodiment of the training pole according to the invention based on the figures. Here.

SPECIFIC DESCRIPTION OF THE INVENTION

Figures 1A, 1B, 1C:
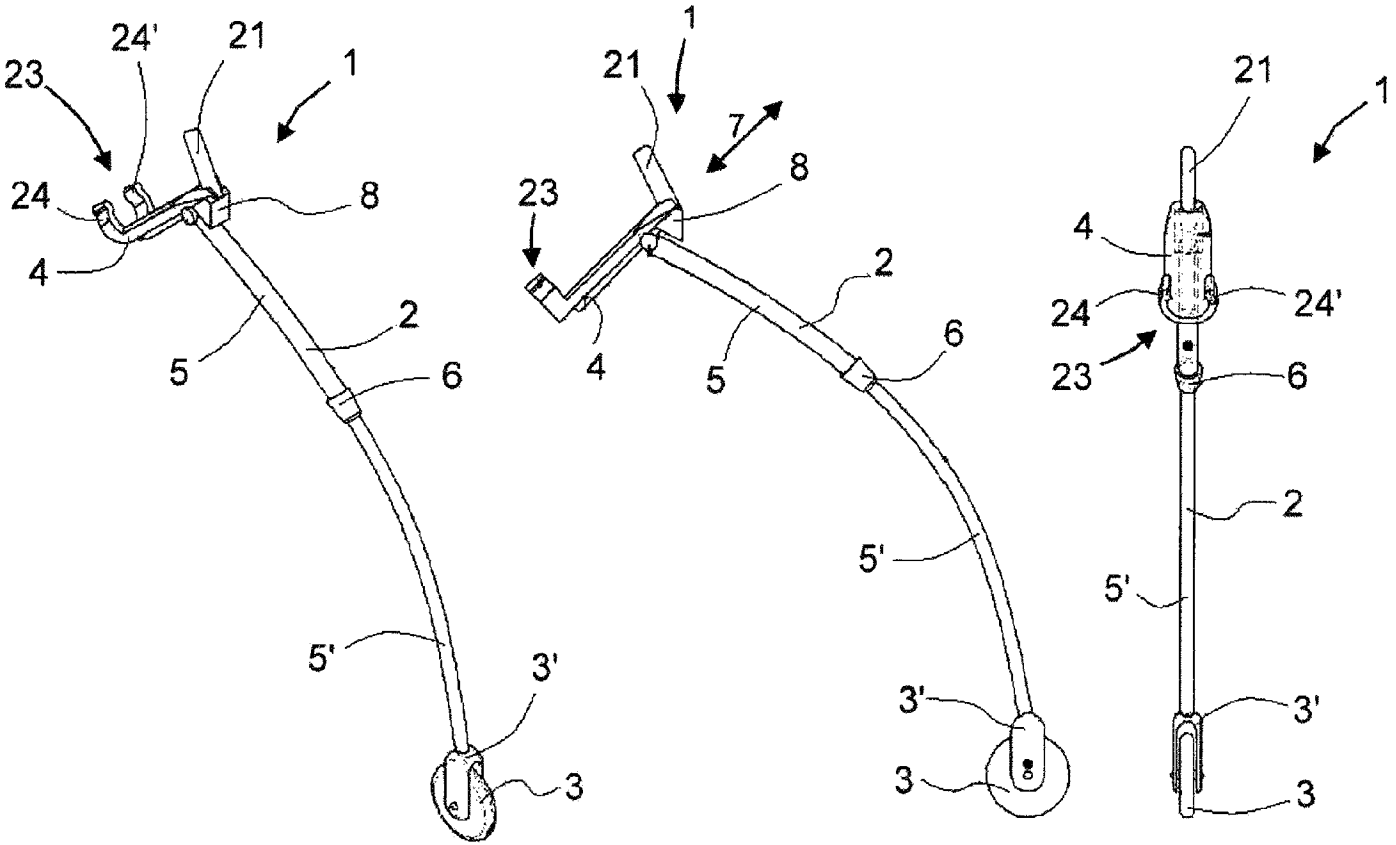
FIG. 1*a* is a perspective view of a training pole.
FIG. 1*b* is a side view of the training pole.
FIG. 1*c* is a rear view of the training pole.

The training pole 1 is essentially composed of a pole 2 on whose one end a bracket 3 carries a wheel 3. A forearm rest 4 is pivoted on the other end. The pole 2 is designed to telescope so that it can be adapted to the body size of the athlete. To this end, the pole 2 in the case illustrated is composed of two tubes 5 and 5' that telescope in each other and are lockable by a clamping screw 6. In addition, the pole 2 is pivoted and displaceable in the direction of the arrow 7 (see FIG. 1*b*) on the forearm rest 4. A stop 8 (FIG. 1*b*) is provided on the front end of the forearm rest 4 to prevent an angle α (FIGS. 2 and 3) from being less than a predetermined angle.

In the case illustrated, the tubes 5 and 5' are bent, thereby reducing excessive impact stresses due to the associated spring-like effect when the training pole 1 is bumped on the ground. An elastic element such as shown schematically at 29 (FIG. 2) can also serve to reduce impact stress.

Figure 2:
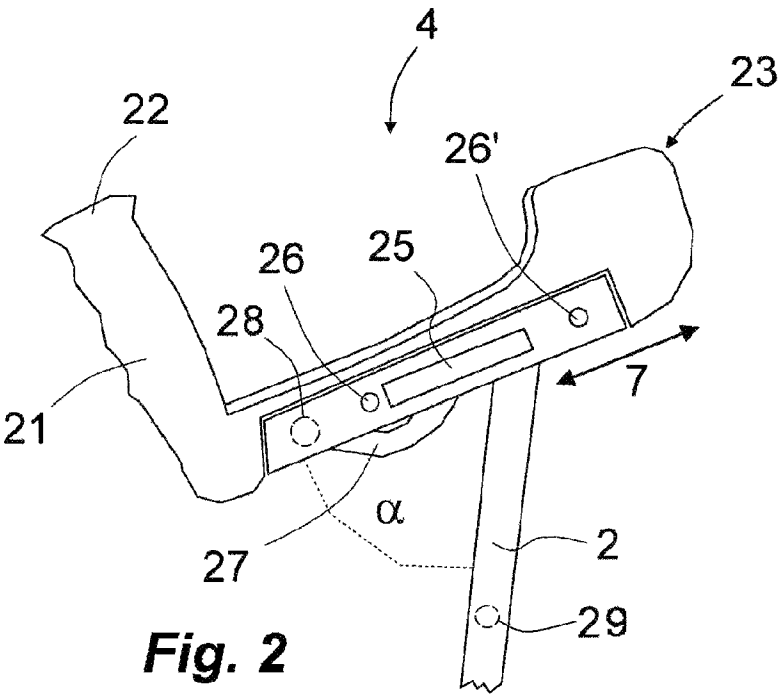
FIG. 2 is a schematic view of a forearm rest.

FIG. 2 provides a detailed view of the forearm rest 4. A handgrip 21 is provided at the front end of the forearm rest 4, this element in turn having a knob 22 at the upper end that prevents the hand from unintentionally sliding off during training. A clamp or coupling 23 is provided at the rear end of forearm rest 2, this element in the case illustrated being composed of two jaws 24 and 24' that engage around the forearm by more than 180° (see FIGS. 1*a* and 1*c*).

The forearm rest 4 is pivoted on the pole 2 that is also adjustable in the direction of arrow 7. In order to realize both possible adjustments, the pole 2 is attached to the forearm rest 4 by a quick-release closure 25 that engages cylindrical holes at pivots 26 and 26'. The extent of pivoting is detected by a sensor illustrated schematically at 28 (FIG. 2).

Figure 3:
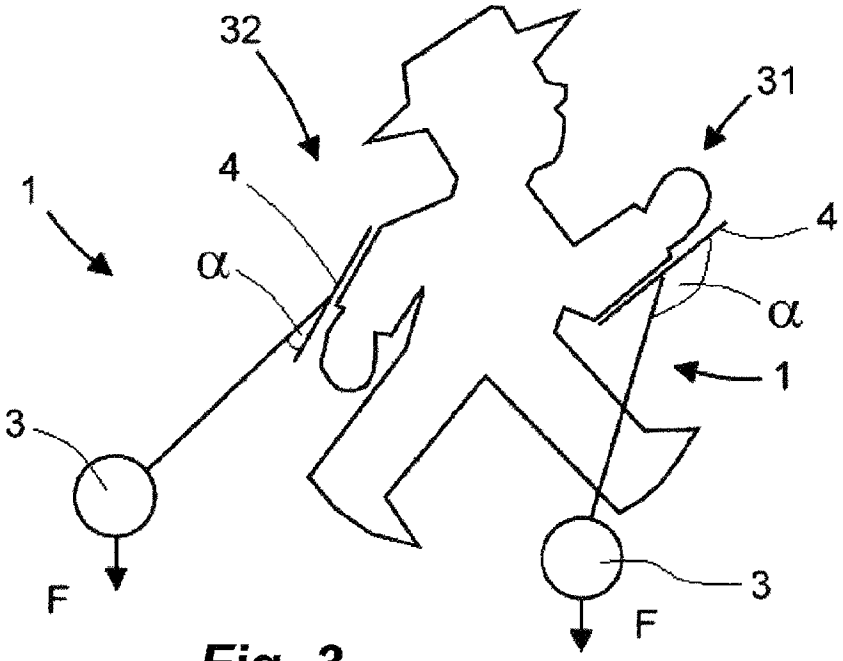
FIG. 3 is a schematic view of a movement sequence.

During a movement sequence illustrated by the schematic figure of a man in FIG. 3, the inclination angle α varies from 30° to 150°, with the greatest possible inclination angle α being assumed at a starting position 31, at which the arm points in the direction of motion. Conversely, the inclination angle α assumes its smallest value at the position in which the arm is moved the furthest distance rear (position 32).

An elastic element 27 is mounted on the forearm rest 4 so that the wheel 3 is pressed down by a force F onto the ground and thus continues to roll along the ground even during rearward motion, which element 27 ensures that the inclination angle α is increased against the force of this restoring element 27. Alternatively, it is also possible to provide a spring for this purpose.

The invention claimed is:

1. A training apparatus for an athlete who trains by walking on a ground surface in a travel direction, the apparatus comprising:

an elongated pole whose lower end carries at least one wheel having a freewheel permitting rolling of the wheel on the surface only in the travel direction, a forearm rest adapted to fit around a forearm of the athlete and pivotally attached to an upper end of the pole such that an angle of inclination of the rest is freely variable with respect to a pole longitudinal axis as the pole is pressed against the ground surface by the forearm of the athlete during walking of the athlete, the angle increasing on rolling of the wheel in the travel direction from a position behind the athlete to a position in front of the athlete as the arm in the rest swings forward in the travel direction, a handgrip fixed on a front end of the forearm rest, positioned to be gripped by a hand of the forearm in the rest, and pivotal with the forearm rest, and a spring element braced between the rest and the pole and pivotally biasing the rest so as to increase the inclination angle, whereby a biasing force of the spring presses the wheel against the ground surface during forward and rearward swinging during walking of the arm on the rest.

2. The training apparatus according to claim 1, wherein the pole, or that the upper end of the pole is elastically pivotable together with the forearm rest and the handgrip relative to a lower part of the pole below the upper end and forearm rest.

3. The training apparatus according to claim 2, wherein the pole is composed of multiple telescoping tubes fitted into each other and lockable relative to each other.

4. The training apparatus according to claim 1, wherein multiple pivots of the pole are provided on the forearm rest.

5. The training apparatus according to claim 1, wherein the pole is partly elastic or bent.

6. The training apparatus according to claim 1, further comprising:

at least one stop that limits the inclination angle between the forearm rest and the pole axis to between 30° and 150°.

7. The training apparatus according to claim 1, wherein the forearm rest is of a shell-like form and partially surrounds the forearm and a wrist of the athlete using the apparatus.

8. The training apparatus according to claim 1, wherein the handgrip is provided with a knob at its upper end.

9. The training apparatus according to claim 1, wherein the forearm rest includes a clamp or coupling adapted to hold the forearm of the athlete in an elastically form-fitting fashion.

10. The training apparatus according to claim 1, wherein the forearm rest is elastic both vertically and in the travel direction.

11. The training apparatus according to claim 1, wherein the inclination angle of the forearm rest is detected by a sensor, with the result that the total mechanical work of a training session is measurable.

12. The training apparatus according to claim 1, wherein an elastic element integrated in the pole is compressed load-proportionally when the supporting load is applied, and thereby also measures the totality of the supporting force of a training session.

* * * * *